US005893460A

United States Patent [19]

Castro et al.

[11] Patent Number: 5,893,460

[45] Date of Patent: Apr. 13, 1999

[54] SHRINKABLE TUBING WITH INTEGRAL TEAR STRIP

[75] Inventors: Joseph Castro, Freeport; Seymour Naps, Oceanside, both of N.Y.

[73] Assignee: Halpak Plastics, Inc., Deer Park, N.Y.

[21] Appl. No.: 08/326,059

[22] Filed: Oct. 19, 1994

Related U.S. Application Data

[63] Continuation of application No. 07/903,912, Jun. 25, 1992, abandoned.

[51] Int. Cl.[6] ..... B65D 65/00

[52] U.S. Cl. ..... 206/497; 229/87.05; 383/207

[58] Field of Search ..... 383/200, 201, 383/207, 209, 210, 211, 88, 94; 229/87.05; 206/497

[56] References Cited

U.S. PATENT DOCUMENTS

| | | | |
|---|---|---|---|
| 3,254,829 | 6/1966 | Cooper | 383/209 X |
| 3,259,235 | 7/1966 | Sowle | 383/209 X |
| 3,260,358 | 7/1966 | Gottily et al. | 383/209 X |
| 3,261,538 | 7/1966 | Jones et al. | 229/87.05 X |
| 3,341,108 | 9/1967 | Kirk | 383/200 X |
| 3,679,048 | 7/1972 | Fujio | 206/497 |
| 4,903,843 | 2/1990 | Fischer | 383/201 X |
| 4,958,735 | 9/1990 | Odabashian | 206/497 |

FOREIGN PATENT DOCUMENTS

| | | | |
|---|---|---|---|
| 0205572 | 8/1990 | Japan | 229/87.05 |
| 3275465 | 12/1991 | Japan | 229/87.05 |
| 4201866 | 7/1992 | Japan | 229/87.05 |

*Primary Examiner*—Jes F. Pascua

*Attorney, Agent, or Firm*—Schweitzer Cornman Gross & Bondell LLP

[57] ABSTRACT

A packaging sleeve of heat-shrinkable thermoplastic comprising a flattened tube having a first wall and second wall connected along parallel first and second lines of connection; lines of weakness formed in said first and second walls proximate to one of said lines of connection; said lines of weakness and the line of connection defining tear strip zones therebetween; a reinforcing-levering band in said zones formed by welding superimposed portions of said first and second walls; said reinforcing levering band being disposed parallel to said lines of weakness and in combination with said zones and lines of weakness establishing a tear strip for opening the sleeve.

1 Claim, 3 Drawing Sheets

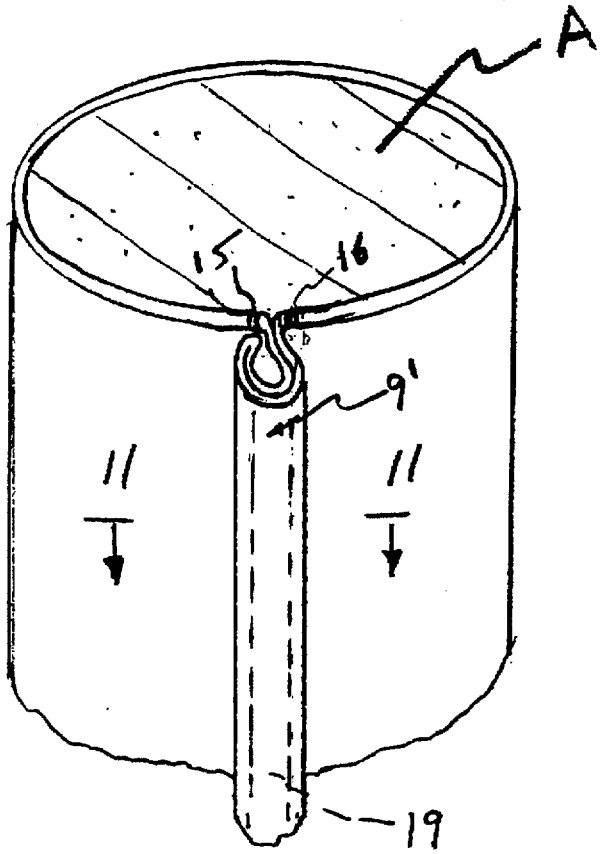
FIG 10
FIG 11
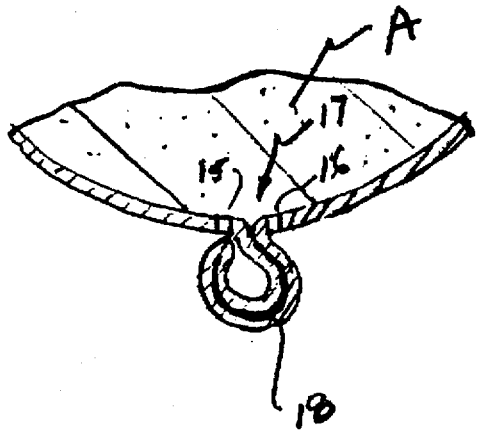

SHRINKABLE TUBING WITH INTEGRAL TEAR STRIP

This is a continuing application of U.S. Ser. No. 07/903, 912 filed on Jun. 25, 1992, now abandoned.

BACKGROUND AND SUMMARY OF THE INVENTION

The packaging and labeling arts have long used heat shrinkable plastic tubing, typically polyvinylchloride (PVC) for the purposes of quickly and efficiently banding together multiples, groups or combinations of products and/or in labeling products of any shape or securing promotional premiums or the like to articles. The heat shrinkable bands or labels employed heretofore have been manufactured primarily as "seamless" tubing, by pneumatically expanding a continuously formed hollow cylinder of PVC or polyethylene and then permitting the expanded cylinder to be cooled. The resulting tubing has a "memory" and will shrink radially and longitudinally upon the subsequent application of heat thereto. Alternatively, heat shrinkable tubing has been formed by taking flat sheets or webs of heat shrinkable PVC or other heat shrinkable material and forming the same into a "tube" or band folding the sheets or webs and connecting the free ends by a sealed seam or joint. The resulting tubing is "seamed".

Disclosed herein is a new and improved method of continuously forming a heat shrinkable packaging medium having a new and improved integral tear strip. The method generally comprises the steps of supporting a roll of flat folded heat shrinkable seamless tubing material for controlled unwinding; directing a web of tubing drawn from the roll toward a sealing station; forming perforations along one edge of the tubing; directing the perforated tube to an ultrasonic welding station; applying ultrasonic welding energy exteriorly and longitudinally of the tube while pinching the walls thereof between an ultrasonic horn means bearing against lower exterior surfaces of the tubing proximate to the perforations and a sealing bar means bearing against the upper surfaces of the tubing, thereby welding said walls into a permanent tear strip; and advancing the welded tube with the integral tear strip to a rewind station.

The resulting heat shrinkable tubular element comprises a shrinkable packaging sleeve having juxtaposed top and bottom walls, the sides of which are the parallel fold lines of tubing. The ultrasonically established weld permanently joining the top and bottom walls adjacent to the perforations defines an easy-opening tear strip which, when subsequently heat shrunk, forms a readily graspable element which projects from the periphery of the object about which the sleeve is placed.

For a better appreciation of the principles of the present invention and a more complete understanding of its attendant advantages, reference should be made to the following detailed description of the invention taken in conjunction with the accompanying drawings.

DESCRIPTION OF THE DRAWINGS

FIG. 10 is a perspective view of a shrunken sleeve with new tear strip projecting outwardly therefrom; and FIG. 11 is a fragmentary cross-sectional view taken along line 11—11 of FIG. 10.

DETAILED DESCRIPTION OF THE INVENTION

Figure 1:
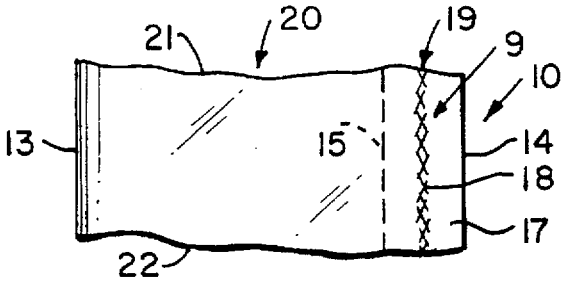
FIG. 1 is a schematic plan view of heat shrinkable tubing embodying the tear strip opening feature of the invention.
Figure 2:
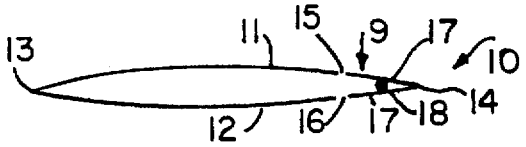
FIG. 2 is a cross-sectional view taken along line 2—2 of FIG. 1.

A heat shrinkable band or sleeve 20 of thermoplastic made from flat folded seamless tubing 10 is formed advantageously from PVC or from polyethylene or any other heat shrinkable packaging material by techniques well known in the art. While the invention will be described hereinafter with reference to flattened "seamless" tubing, it will be appreciated by those skilled in the art that the new and improved tear strip to be described hereinafter may be incorporated with facility into "seamed" tubing made from a sheet of PVC or other thermoplastic which is folded upon itself to form one edge by a fold line while the opposite edge is seamed by a weld to establish the tube. In either event the heat shrinkable tubing, whether seamless or seamed, may be provided with an integrated tear strip as to be described hereinafter.

The sleeve 20 is provided adjacent to one edge 14 thereof with lines of weakness 15 and 16 formed by holes or cuts disposed in lines of perforation parallel to the side edges 13, 14 which are "lines of connection" for walls 11 and 12. The area between the lines of perforation 15, 16 and the side edge 14 are definitive of tear strip zones 17 which are reinforced and strengthened by a line or lines of heat welding 18 definitive of a reinforcing-levering band 19 which is comprised of the fused portions of the walls 11 and 12 and the heat seal 18 within the tear strip zones 17. The tear strip zones 17, welded band 19, and lines of weakness 15, 16 define a readily removable tear strip 9, which when heat shrunk will curl into an arcuate rib-like structure 9' which projects from the remainder of the band, and which may be readily grasped and pulled to sever the sleeve 20 to provide access to the article A upon which it has been shrunk. (See FIGS. 10 and 11)

In accordance with the invention, when a sleeve 20 is severed from the continuous length of PVC tubing 10 to have a height determined by the spacing of the parallel top and bottom edges 21, 22, that sleeve 20 may be heat shrunk over an object A or a plurality of objects to be packaged by the new and improved band. When the band or sleeve 20 is shrunk over an article, the tear strip zone 17 curls to project from the plane of the article and provide a readily graspable rib 9' It is of course well known in this art that such shrinkable PVC bands provide excellent tamperproof packaging for products. The tear strip construction of the new and improved band accommodates the ready opening of the of the new and improved band accommodates the ready opening of the packages formed by the employment of the heat shrinkable band over an object or objects. The band may be severed and removed from its underlying packaged article or articles by grasping the rib 9' formed by the shrunken tear strip zones 17 and twisting and/or pulling the rib 9' away from the remainder of the shrunken band. With the leverage provided by the reinforced zones 17, at least one line the perforations 15, 16 forming the lines of weakness is totally severed permitting ready access to the packaged goods after removal of the sleeve 20.

Several alternative embodiments 40, 60, 80 involving the use of a tear strip which is of greater thickness than the tear strip 9 illustrated in FIG. 1 are shown in FIGS. 3 to 8.

Figure 3:
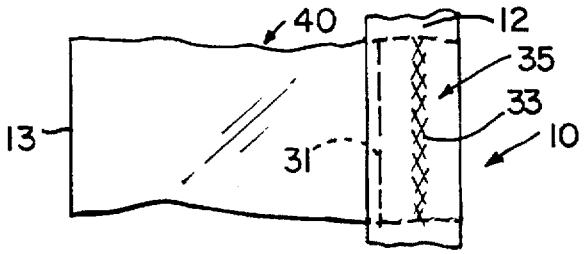
FIG. 3 is a schematic plan view of an alternative construction of the new tear strip construction.

More particularly with reference to FIG. 3 the sleeve 40 may be folded at one edge 14 inwardly of the remainder of the tubing to form a four layered tear strip zone 30 formed between lines of perforation 31, 32 formed in the walls 11 and 12 as shown. A line or lines of welding 33 fuse together the two layers 12 and the two layers 11 within the tear strip zone 30 formed between the folded side edge 34 and the lines of weakness 31, 32, (which lines may be formed in the manner of the lines of weakness 15, 16 by perforations, cuts, or a combination thereof) and establish a tear strip 35. The sleeve of shrinkable PVC 40 may be applied to an object or objects in the same manner as the sleeve 20 and may be opened by pulling the tear strip 35, to sever the sleeve along at least one of the lines 31,32. The strip 35 is strong and, when subjected to heat and shrunken into a rib, may be readily grasped, twisted and/or otherwise manipulated to provide sufficient leverage to sever the walls 11 and 12 along the lines of weakness 31,32 as will be understood.

Another alternative embodiment of the present invention may be formed from a PVC sleeve 60 having parallel edges 13, 14 and lines of weakness 15, 16 formed in the same manner as the lines of weakness disclosed hereinabove, and having tear strip zones 50 formed between the lines of weakness 15, 16 and the side edge 14. The sleeve 60 includes a reinforcing strip 51 superimposed on the wall 11 of the PVC tube within one of the zones 50 and welded to the wall 11 by a heat seal 53 which joins the strip 51 as well as the walls 11 and 12 within the tear strip zone 50 to establish a three layer tear strip 54. The tear strip 54, when shrunken into a rib, may be grasped and pulled for severing the lines of weakness 15 and 16 to open the sleeve 60.

Figure 5:
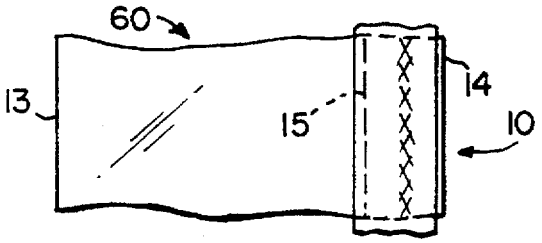
FIG. 5 is a schematic plan view of an alternative construction of the new tear strip construction.
Figure 6:
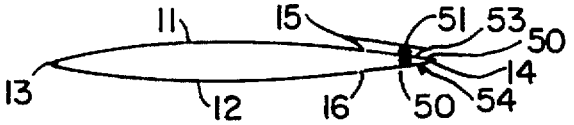
FIG. 6 is a cross-sectional view taken along line 6—6 of FIG. 5.
Figure 7:
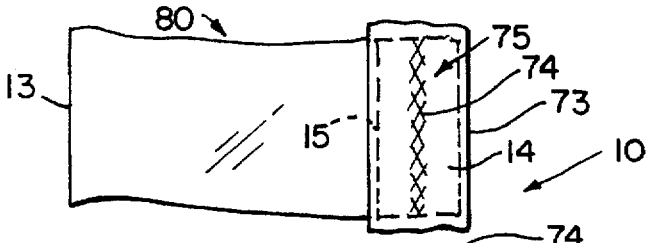
FIG. 7 is a schematic plan view of an alternative construction of the new tear strip construction.
Figure 8:
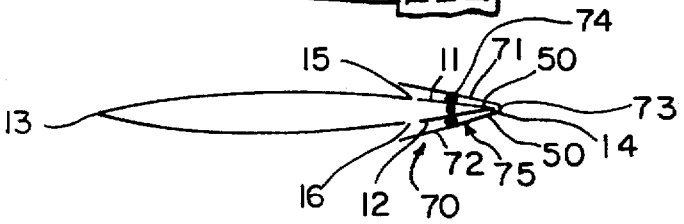
FIG. 8 is a cross-sectional view taken along line 8—8 of FIG. 7.
Figure 9:
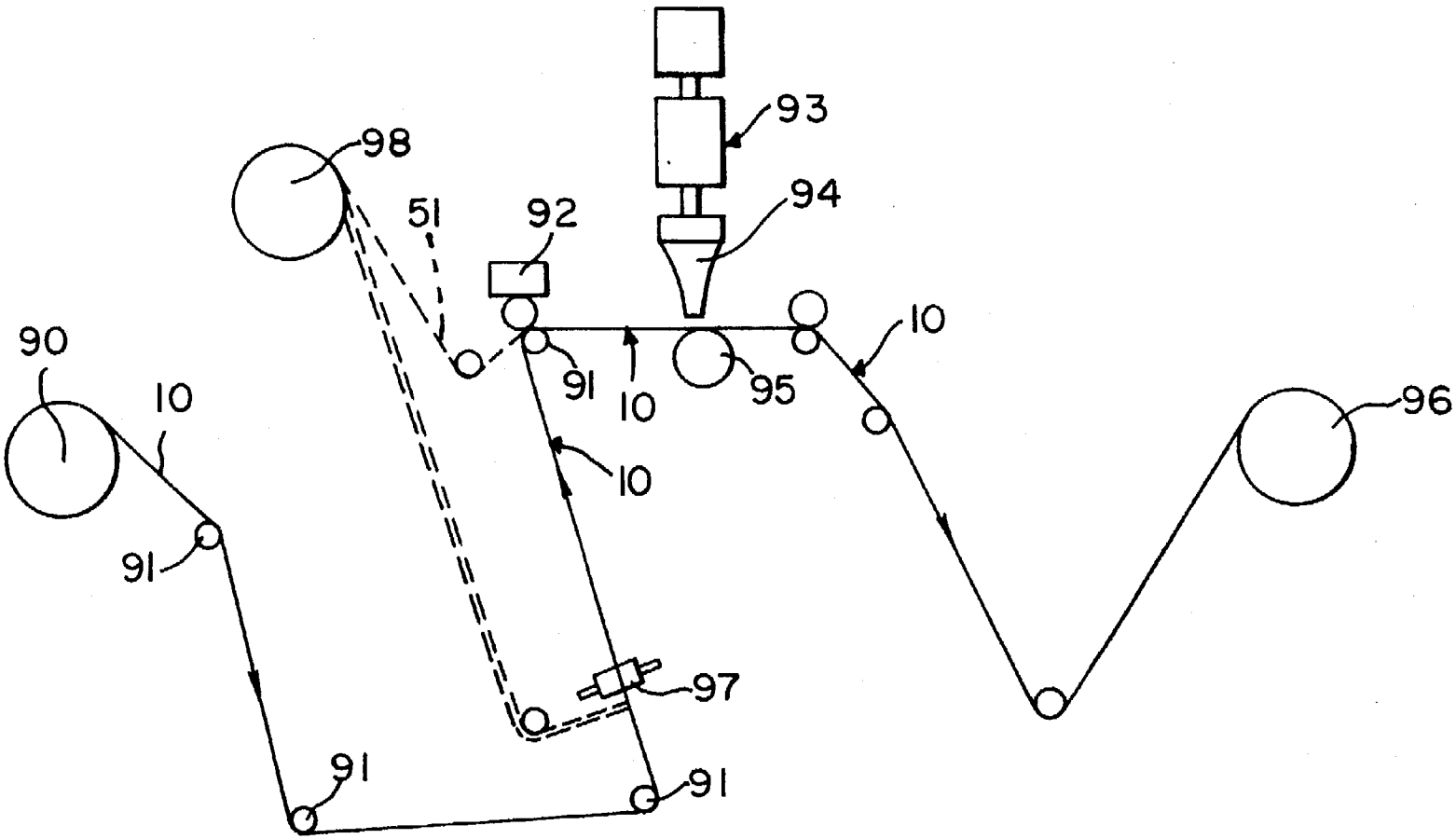
FIG. 9 is a schematic view illustrating the methods and apparatus for manufacturing PVC packaging bands with the new and improved tear strips.

Another alternative of tear strip construction somewhat similar to that shown in FIGS. 5 and 6 is illustrated in FIGS. 7 and 8 wherein the tear strip zones 50 are reinforced by a folded strip of PVC 70 having an upper layer 71 a lower layer 72 folded about score line 73 which is juxtaposed with the side edge 14 as will be understood. The layers 71 and 72 are joined with the wall portions 11, 12 within the zones 50 by a line or lines of welding 74 to provide a four layer tear strip 75 which, when shrunken into a rib, is well suited for severing the lines of weakness 15 and 16 and removing the tear strip in the manner described hereinabove.

The shrinkable band or sleeve having the new and improved tear strip opening feature integrated therein may be easily manufactured on a continuous basis utilizing readily available equipment. For example a roll of tubing 10 may be unwound from a unwinding station 90 and directed over a series of idler rolls 91 to a perforating station 92 where the lines of weakness 15, 16; 31, 32 are formed parallel to the edge 14 of the tubing 10. From the perforating station 92 the tubing is directed to an ultrasonic welding station 93 having an ultrasonic welding horn 94 and an underlying rotating sealing wheel 95 where the welds 18, 33, 53 and/or 54 are formed adjacent to the lines of weakness as described hereinabove. From the welding station 93 the welded and perforated tubing may be directed to a rewind station 96 as will be understood. Thereafter the continuous PVC tubing having an integrated tear strip formed adjacent the lines of perforation may be cut into individual heat shrinkable bands in known fashion.

Figure 4:
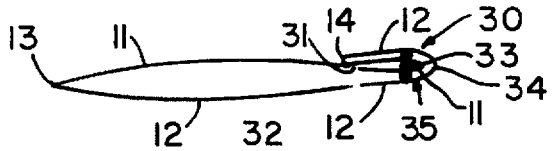
FIG. 4 is a cross-sectional view taken along line 4—4 of FIG. 3.

The above-described apparatus may be modified to include a folding unit 97 which is employed when the PVC band 40 illustrated in FIGS. 3 and 4 is to be manufactured. The folding station will fold the edge portion 30 to form the four layers as described hereinabove. The station 97 may also be employed to fold the reinforcing strip 70 after it has been directed from unwinding station 98 and directed along the path indicated by the double broken lines to a position in which it is juxtaposed with the tubing 10. The unwind station is also employed when it is desired to join an unfolded reinforcing strip 51 with the tubing 10 prior to perforation and sealing.

It should be particularly understood that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. An elongated article having a rupturable sleeve of thermoplastic shrunken thereover, said sleeve comprising (a) a generally cylindrical tube open at its top and bottom having opposed first wall portions and second wall portions connected along parallel first and second side edges;

(b) juxtaposed lines of weakness formed in said first and second wall portions proximate to one of said side edges;

(c) said juxtaposed lines of weakness and the side edge defining tear strip zones therebetween;

(d) a reinforcing-levering band in said zones in the form of an arcuate rib formed by welding superimposed portions of said first and second wall portions;

(e) said reinforcing levering band being disposed parallel to said lines of weakness and in combination with said zones and lines of weakness establishing a tear strip for opening the sleeve from top-to-bottom along one of said side edges.

(f) said reinforcing-levering band being generally arcuate in cross-section and projecting outwardly from the surface of said article;

(g) whereby said band may be grasped and pulled to sever said lines of weakness and facilitate the removal of said sleeve from said article.

* * * * *